US006551229B1

(12) United States Patent
Shipherd et al.

(10) Patent No.: US 6,551,229 B1
(45) Date of Patent: Apr. 22, 2003

(54) APPARATUS FOR FOLDING PAPER-LIKE OBJECTS

(76) Inventors: Keith Shipherd, 150 Collins Dr., Pleasant Hill, CA (US) 94523; Kyle Shipherd, 150 Collins Dr., Pleasant Hill, CA (US) 94523

( * ) Notice: Subject to any disclaimer, the term of this patent is extended or adjusted under 35 U.S.C. 154(b) by 0 days.

(21) Appl. No.: 09/552,174

(22) Filed: Apr. 18, 2000

(51) Int. Cl.[7] ..... B31F 1/00
(52) U.S. Cl. ..... 493/435; 493/475
(58) Field of Search ..... 493/435, 475, 493/476, 478, 479; 271/273, 274

(56) References Cited

U.S. PATENT DOCUMENTS

| | | | | |
|---|---|---|---|---|
| 1,193,382 A | | 8/1916 | Hayes et al. | |
| 3,326,439 A | | 6/1967 | Sarka | |
| 4,158,429 A | | 6/1979 | Ohmori | |
| 4,426,046 A | | 1/1984 | Heuckroth | |
| 4,721,504 A | * | 1/1988 | Cogswell et al. | 493/179 |
| 4,860,649 A | * | 8/1989 | Popkin | 101/137 |
| 4,958,829 A | | 9/1990 | Ward, Jr. | |
| 5,124,755 A | * | 6/1992 | Hediger | 219/216 |
| 5,143,365 A | * | 9/1992 | Green | 271/110 |
| 5,701,727 A | * | 12/1997 | Lundstrom et al. | 156/441.5 |
| 5,967,512 A | * | 10/1999 | Irsik | 226/177 |

* cited by examiner

*Primary Examiner*—Scott A. Smith
*Assistant Examiner*—Nathaniel Chukwurah
(74) *Attorney, Agent, or Firm*—Theodore J. Bielen, Jr.

(57) ABSTRACT

An apparatus for folding paper-like objects utilizing a housing which supports a tray. The tray includes a surface which is angled downwardly relative to a horizontal plane to permit gravity feed of paper objects along the tray. A first roller fixed along its axis is supported by the housing while a second adjustable roller is also mounted to the housing. The adjustment is determined by mounting the axle of the second roller in an eccentric collar which moves the axis of the second roller when the collar is rotated.

6 Claims, 3 Drawing Sheets

APPARATUS FOR FOLDING PAPER-LIKE OBJECTS

BACKGROUND OF THE INVENTION

The present invention relates to a novel and useful apparatus for folding and sealing paper-like objects.

In the past, devices have been utilized to fold and seal objects such as envelopes. In general, folding of the object was accomplished by a separate set of rollers from those used to seal the object. Prior rollers have been adjustable by the use of a locking mechanism and a spring biasing control. The spring bias control generally operates to move one roller away from the other. Although initially successful adjusting the spacing or nip between rollers, the spring biasing control deteriorates over time and must be replaced.

Many mechanisms have been used to adjust the distance between two rollers operating in conjunction with one another. For example, reference is made to U.S. Pat. No. 3,326,439 which shows a preloaded structure for cooperating cylinders in which a spring mechanism generates a pressure that tends to hold the rollers together.

U.S. Pat. No. 4,158,429 shows an apparatus for feeding elongated sheet materials in which one of the rollers includes a deformable surface such that elongated sheets of material are better controlled through a pair of rollers.

U.S. Pat. No. 4,426,046 shows a wire drive system having a plurality of rollers which are spring biased toward one another and are used to impart vibration to the wire.

U.S. Pat. No 1,193,382 shows a creasing and cutting attachment for ruling machines in which pinions interlock and are eccentrically mounted on shafts to permit disengagement of the pinions and to remove and repair the knives and creasers used in the machine.

U.S. Pat. No 4,958,829 shows adjustable feed roller for.feeding sheets in which springs are used to control the amount of reloading of eccentric housings which bias the rollers away from one another.

A folding and sealing apparatus which includes a system for easily adjusting the nip between pairs of rollers would be a notable advance in the paper processing industry.

BRIEF SUMMARY OF THE INVENTION

In accordance with the present invention a novel and useful apparatus for folding and sealing paper-like objects is herein provided.

The apparatus of the present invention utilizes a housing which is mountable on any conventional surface. The housing includes a tray which provides a pathway for paper-like objects that are to be sealed and folded. The tray surface is angled downwardly relative to the horizontal plane to provide gravity feed of paper-like objects through the tray.

A first roller is fixed to the housing and rotates about a first axis. The first roller is used in conjunction with a second roller which is spaced from the first roller a predetermined distance to optimize the folding and sealing of paper-like objects. The second roller rotates about a second axis adjacent the first roller and is also supported by the housing.

The critical distance between the first and second rollers is determined by adjustment means. Such distance is referred to as "nip" and varies in many cases between 1 and 2½ mils. A smaller nip than the range recited will usually stalls or jams a folding and sealing device, such as that shown in the present invention. A larger nip will prevent sealing by the machine of successively fed paper-like objects.

The adjustment means for determining the nip between the first and second rollers includes the provision of at least one axle on the second roller. The axle is located along the axis of the second roller. Means is used for determining the position of the axle relative to the housing. Such positioning means takes the form of a plate fixed to the housing and a collar supported by the plate and turnable relative to the plate. The axle of the second roller is supported by a bearing within the collar. The collar, which may be a rounded member, supports the axle of the second roller eccentrically.

In addition, the adjustment means may further include a plate including a clamp that is adjustable to fix the position of the collar supported by the plate. Such clamp may be tightened or loosened by a screw mechanism. The collar may further include a surface which lies outwardly from the plate, and possesses a multiplicity of recesses thereupon. The multiplicity of recesses provides an anchor or purchase point for a tool to permit turning of the collar when the clamping mechanism has been loosened. Of course, the adjustment mechanism of the second roller relative to the housing may include a second axle and the adjustment means structure hereinbefore described with respect to the first axle of the second roller. Thus, a uniform nip may be maintained along the first and second rollers. It should be noted that the first roller may be fixed to the housing such that any adjustment of the nip between the first and second roller occurs only by movement of the second roller relative to the first roller.

It may be apparent that a novel and useful apparatus for folding and sealing paper-like objects has been described.

It is therefore an object of the present invention to provide an apparatus for folding and sealing paper-like objects which is simple to manufacture and operate.

It is another object of the present invention to provide an apparatus for folding and sealing paper-like objects that includes a lesser amount of moving parts from than devices used in the prior art, and is less expensive to manufacture.

A further object of the present invention is to provide an apparatus for folding and sealing paper-like objects which includes an easily adjustable roller relative to a fixed roller without the use of spring mechanisms.

Another object of the present invention is to provide an apparatus for folding and sealing paper-like objects which is less susceptible to jamming than devices in the prior art.

Yet another object of the present invention is to provide an apparatus for the folding and sealing of paper-like objects which is compact and operates at a higher speed than prior art folding machines.

Another object of the present invention is to provide an apparatus for folding and sealing of paper-like objects which employs little energy and possesses longevity in use.

The invention possesses other objects and advantages especially as concerns particular characteristics and features thereof which will become apparent as the specification continues.

For a better understanding of the invention reference is made to the following detailed description of the preferred embodiments which should be taken in conjunction with the prior described drawings.

DETAILED DESCRIPTION OF THE PREFERRED EMBODIMENTS OF THE INVENTION

Various aspects of the present invention will evolve from the following detailed description of the preferred embodiments thereof which should be referenced to the hereinabove-delineated drawings.

Figure 1:
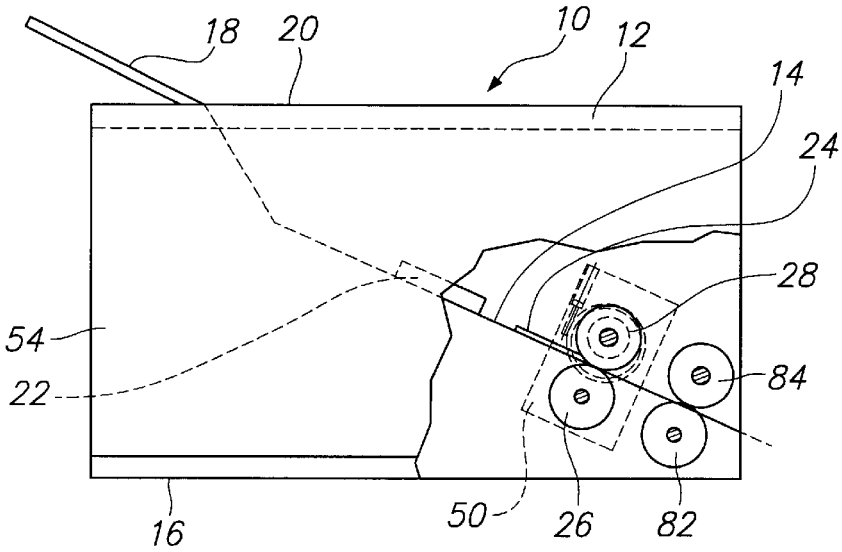
FIG. 1 is a side elevational view of the apparatus of the present invention with the folding and sealing roller depicted in side view from a broken away portion.

The invention as a whole is shown in the drawings by reference character 10, FIG. 1. Apparatus 10 includes as one of its elements a housing 12 housing 10 includes a tray 14 which is angled downwardly relative to base 16 of housing 10 which may sit on a horizontal surface. Feed support 18 extends outwardly from the top 20 of housing 12. In any case, paper-like objects placed on feed 18 pass to tray 14 through a path intended to fold and seal the same. Paper-like object 22 is shown schematically as lying on tray 14 while paper-like object 24 has been partially folded and sealed by the mechanism which will be described hereinafter. In any case, the inclination of tray 14 permits gravity feed of paper-like objects such as paper-like objects 22 and 24 through apparatus 10.

Apparatus 10 further comprises a first roller 26 and a second roller 28. First roller 26 includes axles 30 and 32 which are fixed to housing 12. Roller 26 lies along axis 34 which is immovable relative to housing 12, FIGS. 3 and 6.

The second roller 28 includes axles 36 and 38. Axles 36 and 38 lie along axis 40 which does change its position relative to housing 12, as will be described hereinafter.

Figure 2:
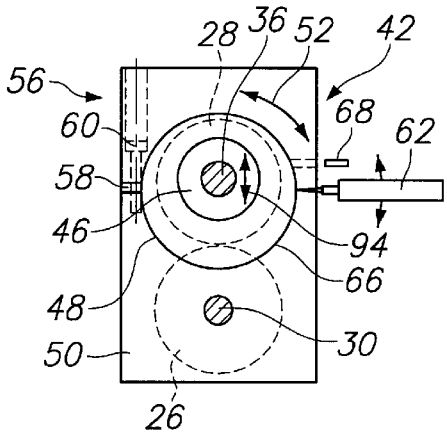
FIG. 2 is a side elevational view of the adjustment means used to determine the nip between a pair of rollers.
Figure 3:
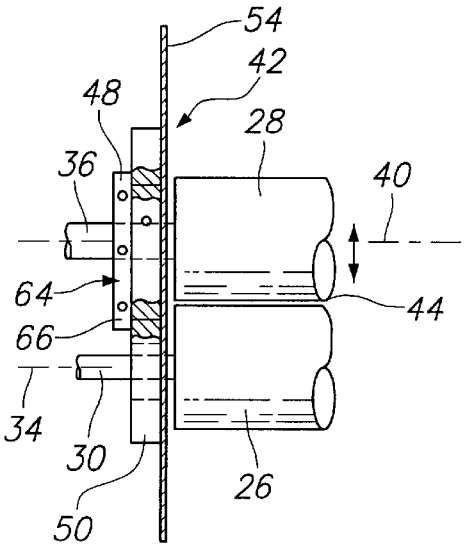
FIG. 3 is a front elevational view of the adjustment mechanism of the present invention with the pair of rollers being shown in part.
Figure 6:
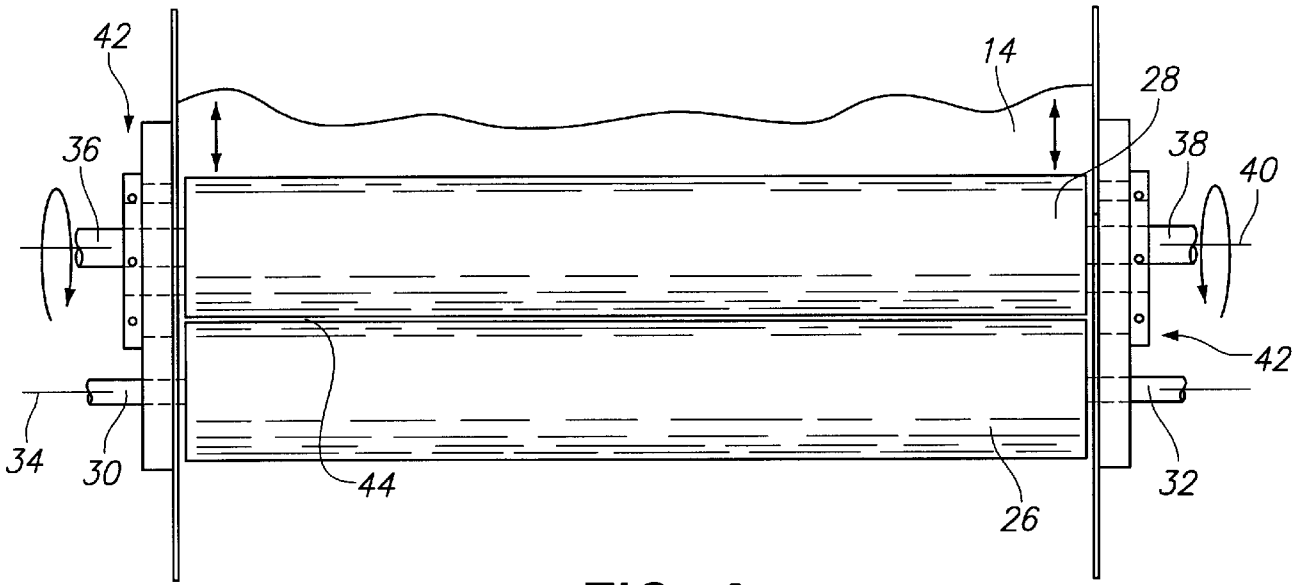
FIG. 6 is a front elevational view of the pair of rollers of the present invention with a small nip between the rollers.

Adjustment means 42 determines the position of axis 40 relative to housing 12 and, most importantly, axis 34 of roller 26. Thus, the nip 44 between roller 26 and 28 is adjusted. For folding and sealing paper-like objects 24, nip 44 varies between 1 mil and 2½ mils. Thus, a very fine adjustment is required to maintain the ability of apparatus 10 to operate. Adjustment means 42 achieves this result by the movement of axles 36 and 38 of second roller 28. With reference to FIGS. 2 and 3, it may be observed that adjustment means 42 on the left side of roller 28 of FIG. 6 is shown. However, it should be understood that an identical mechanism is shown on the right side of roller 28 and, thus, will not be further described.

Figure 7:
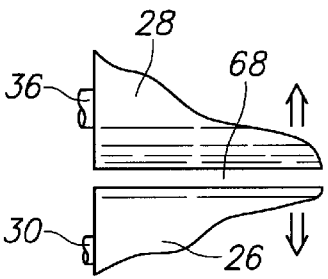
FIG. 7 is a partial front view of the pair of rollers depicted in FIG. 6 with a larger nip between the rollers due to the adjustment means depicted in FIGS. 2 and 3.

Turning again to FIGS. 2 and 3, it may be seen that axle 36 is held to a bearing 46 and is rotatable relative to the same. The outer race of bearing 46 is fixed to a collar 48 bearing 46, as well as axle 36, are eccentrically mounted within collar 48. A plate 50 holds collar 48, but permits collar 48 to rotate according to directional arrows 52. Plate 50 mounts to housing wall 54. The upper portion of plate 50 includes a clamp 56 having a gap 58. Adjusting screw 60 adjusts the size of gap 58 and also loosens or tightens collar 48 within plate 50. When collar 48 is loosened, it is capable of turning according to directional arrow 52. Tool 62 may engage any of the plurality of recesses 64 on surface 66 of collar 48. Set screw 68 fixes the turning of collar 48 relative to plate 50 in conjunction with the tightening of adjusting screw 60 as a portion of clamp 56. In any case, the turning of collar 48 moves the position of axle 38 along axis 40 and, thus, the position of roller 28 relative to roller 26. In this manner, nip 44 is determined between rollers 26 and 28. With reference to FIG. 7, it may be observed that a nip 68 of a very large size has been set between roller 26 and 28, for the sake of emphasis.

Figure 4:
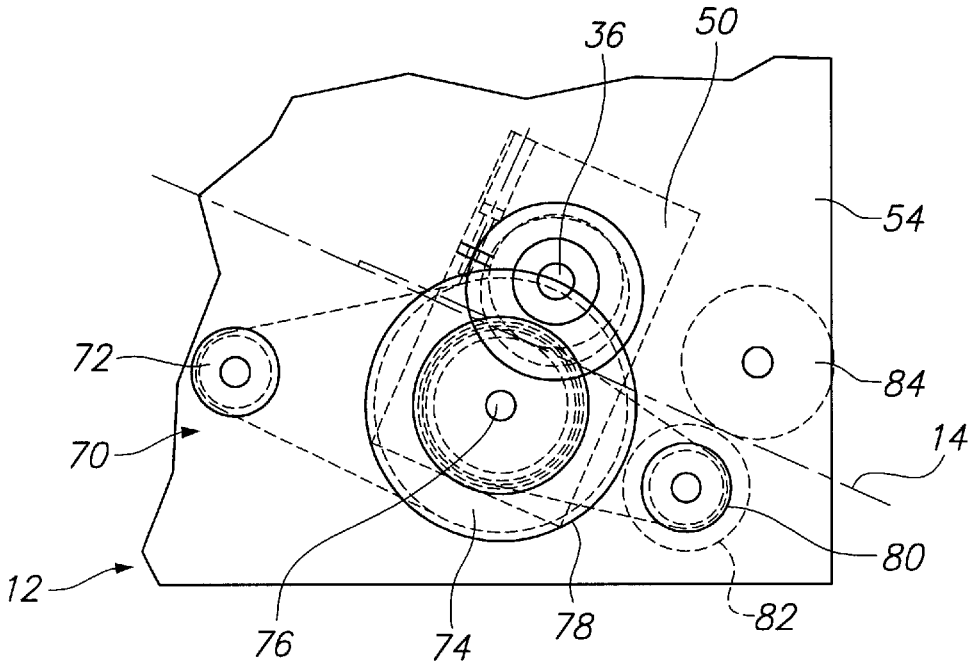
FIG. 4 is a left side elevational view of the apparatus of the present invention showing the mechanism for turning the rollers.
Figure 5:
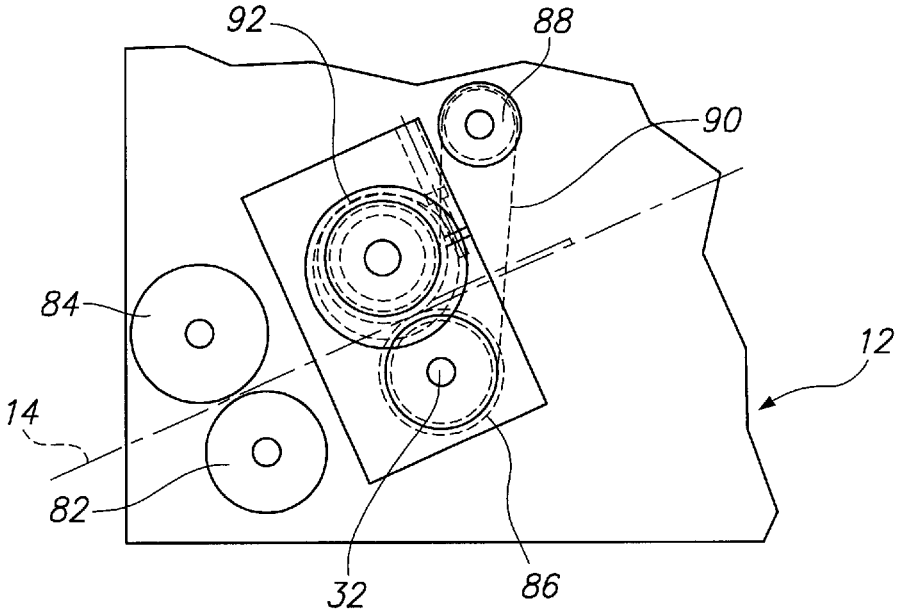
FIG. 5 is a right side view of the apparatus of the present invention showing the mechanism for turning the rollers.

With reference to FIGS. 4 and 5, it may be observed that motivation means 70 for turning rollers 26 and 28. Such means includes a driving gear 72 which is turned by a motor (not shown). Flywheel 74 turns a shaft 76 as well as the outer surface 78 of wheel 74. A belt 80 turns discharge wheel 82 which acts in conjunction with wheel 84. The folded paper-like article 24 passes through wheels 82 and 84 after folding and sealing by rollers 26 and 28. With respect to FIG. 5, gear wheel 86 is linked to gear wheel 88 by chain 90, that turns gear wheel 92, which essentially, revolves or turns roller 28. Shaft 76 connects to or is formed integrally with shaft 30 of roller 26. Thus, chain 90 also turns roller 26.

In operation, the user adjusts the nip 44 between roller 26 and 28 using adjustment means 42. Such adjustment is achieved by the loosening of clamp 56 formed in plate 50 by adjustment screw 60. Tool 62 is then used to turn collar 48 within plate 50. Axle 36 and axis 40 of the same are slightly rotated upwardly or downwardly depending on the degree of rotation of collar 48 according to directional arrow 94, FIGS. 2 and 3. When the proper nip 44 is determined between rollers 26 and 28, adjusting screw 60 is tightened, and said screw 68 is placed against collar 48 within plate 50 to hold the same in place. The same adjustment depicted on FIGS. 2 and 3 takes place on both sides of roller 28 as is depicted in FIG. 7. With nip 44 adjusted properly, paper-like object 24 will pass through rollers 26 and 28 and be folded and sealed in one step.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. An apparatus for folding and sealing paper-like objects, comprising:

a. a housing;

b. a tray, said tray supporting the paper object, said tray including a surface angled downwardly relative to a horizontal plane, said tray held to said housing;

c. a first roller, said first roller rotating about a first axis, said first roller mounted to said housing;

d. a second roller, said second roller rotating about a second axis adjacent said first roller, said second roller being supported by said housing; and e. adjustment means for determining the nip between said first and second rollers to permit said paper object to pass from said tray to and through said nip between said first and second rollers, said adjustment means further comprising an axle located along the axis of said second roller, and means for determining the position of said axle relative to said housing, said means for determining the position of axle relative to said housing further comprising a plate fixed to said housing and a collar supported by said plate and being turnable rela tive to said plate, said axle of said second roller being supported by a bearing within said collar.

2. The apparatus of claim 1 in which said collar supports said axle of said second roller eccentrically.

3. The apparatus of claim 2 in which said adjustment means further comprises said plate including a clamp to fix the position of said collar supported by said plate.

4. The apparatus of claim 3 in which said collar further comprises a surface and a multiplicity of recesses on said surface, said multiplicity of recesses providing purchase for a tool turning said collar relative to said plate.

5. The apparatus of claim 4 in which said surface of said collar extends outwardly from said plate.

6. The apparatus of claim 1 in which said first roller is fixed relative to said housing.

* * * * *